US005660465A

United States Patent [19]

Mason

[11] Patent Number: 5,660,465

[45] Date of Patent: Aug. 26, 1997

[54] APPARATUS AND SYSTEM FOR PRODUCING FOAMED CEMENTITIOUS PRODUCTS

[76] Inventor: Walter R. Mason, 2817 Victoria Ave., Cincinnati, Ohio 45208

[21] Appl. No.: 349,973

[22] Filed: Dec. 6, 1994

[51] Int. Cl.[6] ..... B28C 5/10

[52] U.S. Cl. ..... 366/3; 366/13; 366/15; 366/51

[58] Field of Search ..... 366/3, 10, 13, 366/14, 15, 35, 38, 40, 51, 66, 190, 307, 315, 319, 20

[56] References Cited

U.S. PATENT DOCUMENTS

| | | | |
|---|---|---|---|
| 3,006,615 | 10/1961 | Mason, Jr. | 366/20 |
| 3,307,792 | 3/1967 | Hughes et al. | 366/315 |
| 4,106,116 | 8/1978 | MacKay | 366/315 |
| 4,298,288 | 11/1981 | Weisbrod | 366/51 |
| 5,141,363 | 8/1992 | Stephens | 405/150.1 |
| 5,419,632 | 5/1995 | Stephens | 366/51 |

FOREIGN PATENT DOCUMENTS

| | | | |
|---|---|---|---|
| 2348915 | 4/1975 | Germany | 366/10 |
| 4120895 | 1/1993 | Germany | 366/51 |
| 6150425 | 11/1981 | Japan | 366/190 |
| 1135668 | 1/1985 | U.S.S.R. | 366/51 |

*Primary Examiner*—David Scherbel
*Assistant Examiner*—Randall E. Chin
*Attorney, Agent, or Firm*—Kinney & Schenk

[57] ABSTRACT

An apparatus and method for introducing a metered volume of air into a continuously generated and flowing slurry composed of metered dry cementitious material, metered water and metered air entraining (or foaming) agent and for homogenizing this air into bubbles or cells of relatively small size to produce a uniform cellular product. The apparatus comprises a positive displacement progressive cavity slurry pump driven by a variable speed motor. By driving the pump at a speed in excess of the speed required to accommodate the volume of slurry being generated, the pump will draw air proportionately to this excess of speed. Further elements of the apparatus comprise a closed conduit system for the slurry discharging from the pump, this system communicating with a cylindrical homogenizing apparatus wherein rotating elements homogenize the metered air and slurry with the cooperation of the air entraining agent into a foamed material having relatively small air cells of uniform size. The homogenized slurry material is propelled through and beyond the homogenizing apparatus through a communicating conduit to the point of deposit.

18 Claims, 4 Drawing Sheets

APPARATUS AND SYSTEM FOR PRODUCING FOAMED CEMENTITIOUS PRODUCTS

BACKGROUND OF THE INVENTION

1. Field of the Invention

The present invention relates to a method and a system for continuously metering air into a flowing slurry composed of a dry cementitious material, an air entraining agent and a liquid—and for homogenizing said air into small cells to produce a uniform cellular product. For example, a plaster water slurry used in the metal casting industry to produce light density, aerated, precision plaster molds of high permeability for the production of castings of aluminum or magnesium. Or for a second example, a Portland cement water slurry used for insulating fill in the manufacturing of fire resistant safes, file cabinets, storage units etc. In still broader scope the field of the invention encompasses cellular concrete fills basically of Portland cement used in building construction or in geological technology which involves applications ranging from stabilization of highway embankments to grouting the annulus of relining pipe in sewer retrofit projects.

2. Description of the Prior Art

In the case of light density, cellular molds of plaster produced by companies making aluminum or magnesium castings, the generally accepted mold making method involves a batch process. The major gypsum manufacturers market a special plaster which incorporates a dry powdered surfactant blended into the plaster at the gypsum mill. To prepare a slurry of such plaster for pouring molds, a mixing pail is first charged with a given quantity of water, next a specified quantity of the special paster is added to the water. Following a brief soaking period, a portable (or fixed) motor driven high speed mixing shaft having a blade or disc at its tip is introduced into the mixing pail. The mold maker involved raises and lowers the rotating mixing shaft and disc thereby producing a vortex in the pail. As slurry is generated, the surfactant is activated and proceeds to aerate the slurry and to increase its volume particularly by drawing air into the vortex. After usually one to three minutes of mixing in this manner the body of the slurry has approximately doubled its volume and has become a homogeneous cellular material. When this prepared slurry is bucket poured into case molds or flasks it soon sets into a plaster solid which when dry forms the permeable production molds used in the casting process.

In the case of cellular concrete composed basically of Portland cement, a very different procedure is employed to prepare the slurry although it also is a batch process. Water is typically metered by volume into a mixing drum, then a measured weight of Portland cement is added. However, to aerate the slurry, a fixed quantity of pregenerated foam is added to the mixing drum and blended into the water/cement slurry as mixing by rotating agitators, proceeds. The pregenerated foam has been rendered stable and may be described as semi-solid as it issues or extrudes from the cylindrical nozzle of the foam generator. The foam generator is controlled by a timer and there has been previous calibration of the amount discharged timed to the tenth of a second. Thus the foam component of the mix is relatively accurately added to each batch as it is made. The agitator of blades of the drum type mixer continue to rotate during formation of the batch so that a homogeneous slurry is rapidly obtained. This rapid formation of slurry batches permits the process to function continuously because batches are discharged successively into a large hopper positioned below the mixing drum. The hopper in turn connects to a slurry pump. As batches are prepared and swiftly discharged into the slurry receiving hopper, the delivery pump is continuously pumping the slurry through a hose to the point of use. The rate of delivery or output is determined therefore by the rapidity with which slurry batches can be supplied to the large hopper of the delivery pump.

It can be understood from the above description that the state of the art for producing a cellular product of plaster or of Portland cement offers only imprecise quality control pertaining to certain properties of product, such as density or cellular structure. It is also evident that the production of aerated plaster molds used in production of aluminum or magnesium castings involves a tedious labor intensive process which is more art than technology.

In the production of Portland cement based cellular concrete, quality controls are not accurate because the foamed product is heavily dependent on the quality of the pregenerated foam and the accuracy with which the specified quantity of said foam is added to the batch in preparation. Moreover, in the mixing process pregenerated foam has a tendency to densify by some loss of cellular air and in pumping a foamed slurry through a hose additional loss of cellular air and further densification often occurs. In field practice, the density of the material deposited at the point of use is rarely more accurate than plus or minus three percent from one density check to another.

SUMMARY OF INVENTION

The present invention embodies means for introducing a controlled volume of air into a flowing slurry as previously described and pursuant to accomplishing this it is intended that an apparatus exists such as the one shown in U.S. Pat. No. 3,006,615 for continuously generating a slurry of metered water and metered dry cementitious material and an air entraining agent. At this point a major challenge to which this invention is addressed becomes evident in the question of how to accomplish accurate metering of the desired volume of air into the continuously forming and flowing slurry and which slurry contains an undetermined portion of this air in the form of foam and bubbles. Since the slurry is composed of cementitious dry material, water and foaming agent, it is inevitably to some degree frothy as soon as it is produced. The apparatus shown in U.S. Pat. No. 3,006,615 differs from the present invention precisely in the new purpose and teaching herein outlined. To introduce an accurately controlled volume of air into the flowing slurry, the invention relies on a positive displacement slurry pump which is driven by means which permit accurate variation of the pump speed and especially permit operation of the pump at speeds in excess of that required to accommodate the volume of slurry being produced. When the pump is operating at such higher speeds it is drawing in air along with the slurry. If, for example, the pump output speed is double the speed needed to pump the slurry, then equal volumes of slurry and air will enter the pump. The fact that some of the air is in the slurry is irrelevant because the pump displaces a positive volume as it rotates and all of this volume that is not slurry is air. The slurry with the accompanying metered air (a bubbly, sudsy liquid at this stage) is pumped through a closed conduit which at a certain point connects to a closed apparatus designed to homogenize the air into bubbles or cells of relatively small and uniform size. It should be emphasized that from the moment the metered quantity of slurry and the metered quantity of air enter the positive displacement pump they are in closed system so that the proportion of air versus slurry remains constant for the time they are in said closed system. Following the homogenizing of the air and of slurry together with an air entraining agent or surfactant, a stable product is formed, and thus the proportion of air versus slurry (or density of the material) remains constant even after emerging from the closed system and after being deposited and solidifying to form a uniform cellular structured product.

The function of the air entraining agent as a component of the slurry is to aid in the homogenizing process whereby undefined but measured air moving into the homogenizer is reduced to air cells of a relatively small and uniform size. Additionally, this agent acts to stabilize the matrix of the cementitious material so that it maintains a certain structural rigidity after issuing from said homogenizer and being deposited at the point of use. Such stabilization is necessary to prevent cellular air loss and volumetric change of the deposited product, during the period before the cementitious matrix has hydrated and set into a self supporting solid. The air entraining agent does not generate air or gas for the slurry. Its operating function is to act upon air which has been metered into the slurry by the positive displacement pump.

Air entraining or foaming agents in liquid concentrate form are commercially available and various of these products will perform the functions described here and needed for the present invention.

Accordingly, it is an object of this invention to provide an apparatus and method for producing a cellular cementitious material without the necessity of adding pregenerated foam to the slurry.

It is also an object of this invention to provide a continuous system for the production of foamed plaster molds which supplants the batch process and moreover improves the uniformity of the resultant product.

It is another object of this invention to provide a continuous system for the production of a cellular structured cementitious product which incorporates precise means for varying the density and/or the cellular structures of such product. (Said density is varied according to the speed of the positive displacement pump and the cellular structure can be varied from fine to coarse by adjusting the speed of the motor driving the homogenizing apparatus.)

It is again an object of the invention to permit the slurry homogenizing apparatus to be located near the point where the slurry is deposited, thereby providing a relatively long transmission conduit from the slurry pump to the homogenizer but a relatively short conduit from the homogenizing apparatus to the point of deposit. The homogenized slurry may thus undergo only a minimal deleterious effect to its cellular structure caused by the pumping and delivering operations.

It is a further object of this invention to provide a system which saves man hours when compared with any batch making system currently performing equivalent work. Typically, thirty-five percent less labor time is required when a continuous system replaces a batch system.

It is still another object of this invention to provide equipment and a system capable of producing a cellular structured slurry of Portland cement and water at outputs greater than can be attained by typical batch processes. Such processes have limits imposed by the rapidity with which batches can be prepared for delivery to the slurry hopper.

It is also an object of this invention to provide the most accurate and economical method available for providing foamed slurry for the various industrial and construction operations outlined in the Field of the Invention.

BRIEF DESCRIPTION OF DRAWINGS

FIG. 7 is a section taken on line 7—7 of the progressive cavity pump seen in FIG. 2;

FIG. 8 is another section on line 8—8 of the progressive cavity pump seen in FIG. 2

DETAILED DESCRIPTION OF THE PREFERRED EMBODIMENT

Figure 1:
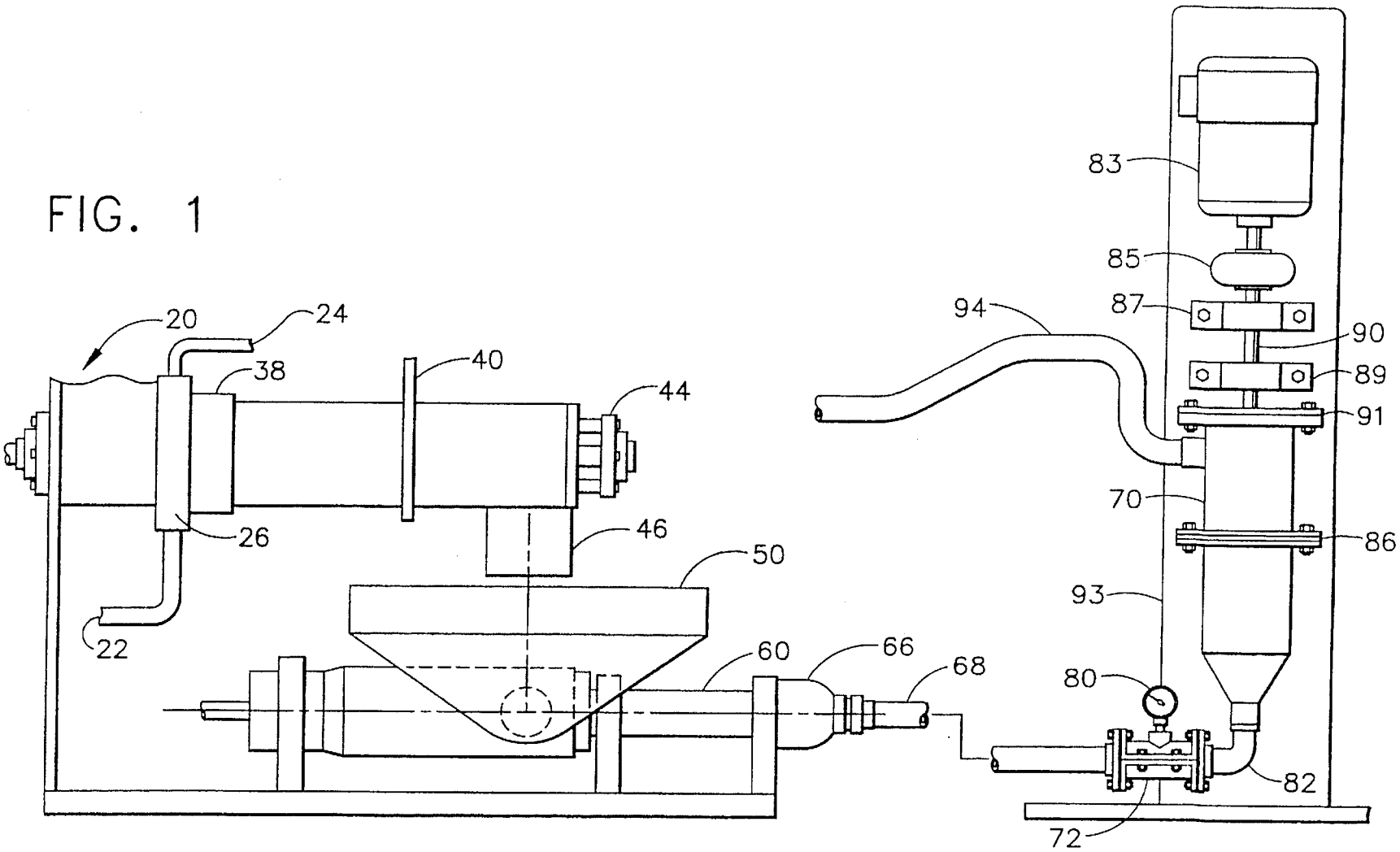
FIG. 1 is a frontal elevation of the system of the invention.

The following description will be directed in particular to elements performing part of or cooperating more directly with the present invention. Elements not shown or described herein are understood to be selected from those known in the art.

In the practice of the invention, there is provided means for continuously metering a dry powered cementitious material and means for continuously metering water and means for commingling these to form a slurry. In addition, means are provided for continuously metering a liquid air entraining agent and for adding said agent to the metered water. The metered components are swiftly transformed into a slurry by a spiral agitator element rotating rapidly within a tubular mixing chamber. Said slurry upon being propelled the length of the mixing tube is constrained to exit downward by gravity through an aperture in the tube. Said slurry is deposited into a receiving hopper which at its lowest point communicates with a positive displacement progressive cavity pump. Said pump is driven by a variable speed motor. The slurry will be drawn from the receiving hopper into said pump which during rotation provides suction at its entry port. By increasing the speed of the positive displacement pump, there comes a point at which air is drawn into the pump along with the metered quantity of slurry. Said air and said slurry proceed through said pump and because said pump is a positive displacement pump, said air and said slurry are sealed within a closed system. In all further description, it is to be assumed that the air entraining agent accompanies the metered slurry within the closed system. By continuing to increase the speed of the slurry pump, a greater volume of air will be metered into the slurry. In this preferred embodiment of the invention, the means for controlling the speed of the pump are infinitely bearable within practical ranges.

The true volume of the non-aerated slurry is determined by weight checking. Only the basic cementitious material and the water have weight. Since they are metered in a certain proportion, the desired density of mixed slurry can be obtained. Then, if for example, the slurry density is twelve pounds per gallon before air is added by the positive displacement pumps and thereafter the slurry weighs six pounds per gallon, it is clear that an equal volume of air has been added to double the initial volume of slurry, (the slurry density, of course, is determined following homogenization of the air into the slurry). A wide range of proportioning air to slurry is available through use of the invention. In practical terms, from ten to two hundred percent of the slurry volume may be increased by such aeration.

A conduit is connected to the positive displacement pump thus insuring that all slurry and air remain in a closed system following exit from said pump. Said conduit conducts the commingled air and slurry a certain distance depending on exigent circumstances, to a cylindrical tank apparatus which performs the homogenizing function. The homogenizer is provided with an inverted conical configuration at the bottom and the conduit connects to the apex (or nadir) of the cone. Within said homogenizer is a centrally positioned drive shaft supporting one or more circular discs which are of a relatively smaller diameter than the inside diameter of the tank homogenizer. Thus there is provided a space between the periphery of each disc and the inside wall of the tank. The drive shaft is disposed as the axis of the cylindrical tank homogenizer and said shaft passes through the top of the tank where a mechanical seal prevents material within the tank from leaking at that point. The drive shaft is coupled to a motor which, in the preferred embodiment, is equipped with means to infinitely vary its speed. Therefore, one or more discs rotate within the homogenizer and it is said discs which are instrumental in homogenizing the slurry. Said slurry upon entering the tank homogenizer at the bottom must flow upward and thence around the periphery of the rotating disc or discs until it reaches an exit aperture through the tank wall located near the top of the tank. If two (or more) discs are placed in the tank an orifice plate may be disposed between them and thereby the slurry is constrained to flow from the periphery of the first encountered disc inward toward the center of the tank and thence upward through the orifice. There is adequate clearance between the axial drive shaft diameter and the diameter of the orifice for the slurry flow. After passing the last encountered disc, the slurry has been changed physically into a fine celled homogeneous material of increased viscosity. This transformed slurry under relatively low pressure next exits from the homogenizer via a conduit which conducts it to the place of deposit. The air entraining surfactant is activated by the homogenizing action described and said surfactant stabilizes the product which the system has produced.

Figure 2:
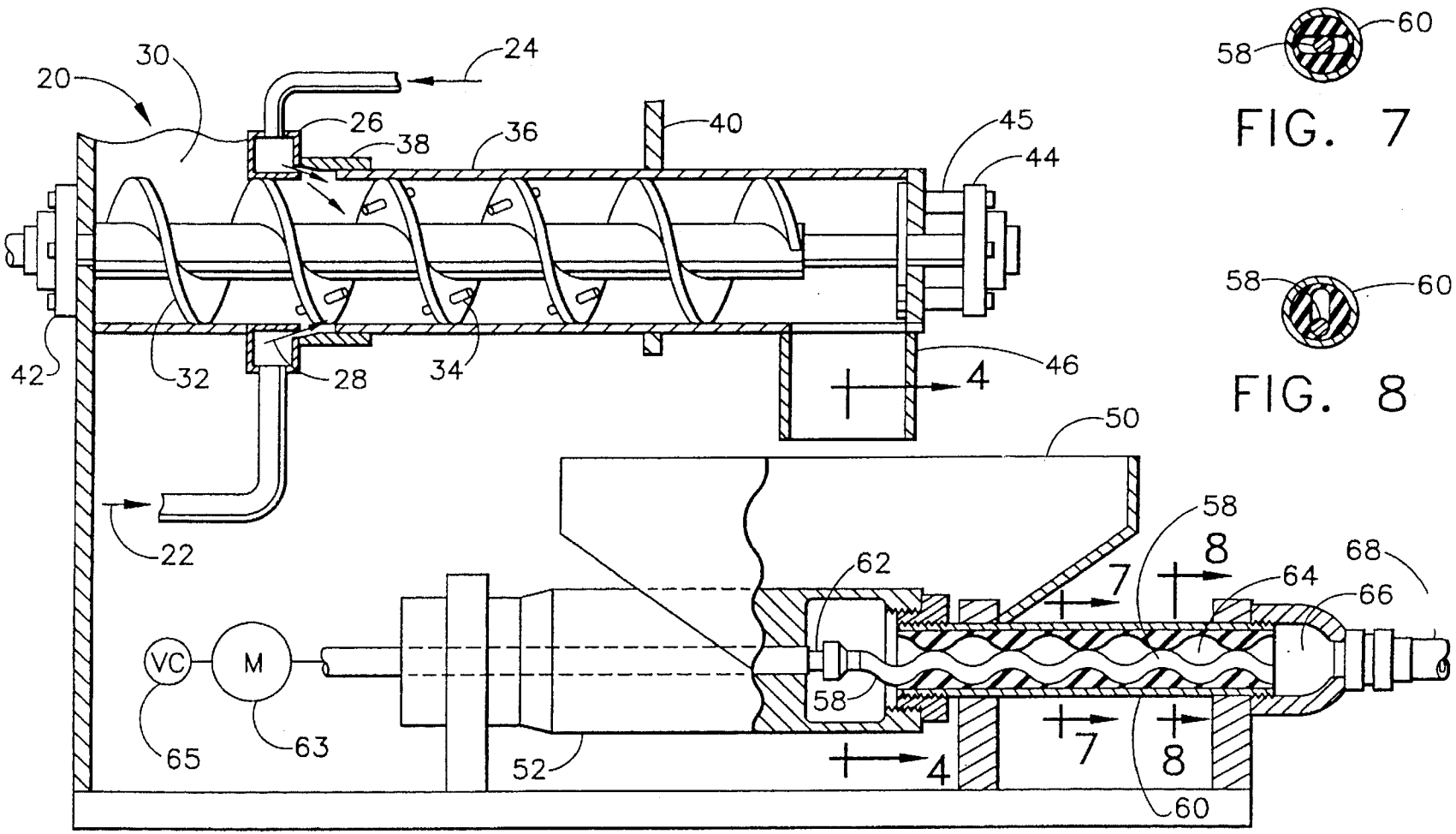
FIG. 2 is a frontal elevation of the slurry generating apparatus partly in section and partly in breakaway.
Figure 4:
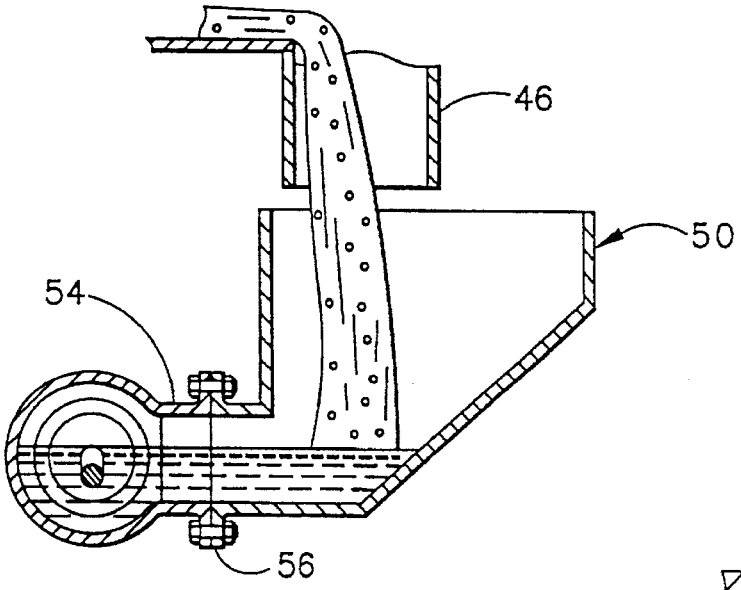
FIG. 4 is a section taken on the line 4—4 FIG. 2.

To explain the invention in greater detail it is necessary to refer in a specific way to the drawings composing the various figures shown. There is provided in FIG. 1 and FIG. 2 means for entry of metered dry cementitious material at 20 and entry for metered water at 22 into an apparatus for producing slurry on a continuous basis. Additionally there is provided an entry 24 for liquid air entraining or foaming agent. Said water and said liquid agent flow from their respective entry pipes into annularly open ring 26. From the interior annulus of the ring 26 the blended water and liquid agent exit through annular opening 28. Said metered dry material continuously enters area 30 at which point screw conveyor 32 propels said cementitious material from left to right through adjacent annular ring 26. Beyond said ring the cementitious material is joined by said metered water and liquid air entraining agent emerging from annular opening 28. Screw conveyor 32 is provided with mixing pins 34 to enhance the mixing action within mixing tube 36. Said tube is supported by collar 38 at one end and by hanger 40 positioned toward the opposite end. Screw conveyor 32, which is shaft mounted, is journaled at the entry end in bearing 42 and at the discharge end in outboard mounted bearing 44 which is positioned by spacers 45 (said spacers prevent any slurry leak from directly impinging the bearing) and is bolted to mix tube 36. Said dry material and said liquids are rapidly blended into a slurry which is conveyed the length of the tube to discharge aperture 46. Said slurry discharges through aperture 46 by gravity and falls continuously into hopper 50. Said hopper communicates with positive displacement progressive cavity pump 52 which incorporates entry port 54, FIG. 4. Said hopper and said pump are bolted together at 56, FIG. 4. Returning to FIG. 2 and noting the cutaway of the positive displacement pump; the pumping element 58 is a chromium plated steel rotor which rotates eccentrically inside stator 60. The extreme positions of rotating rotor 58 within neoprene lined stator 60 are shown in FIG. 7 and FIG. 8. Pump 52 performs an essential role in the functioning of this invention which has been described in the foregoing exposition. Means to drive said pump are indicated by motor 63 and variable control 65 which is capable of infinitely varying the speed of the pump. The motor will be disposed to rotate shaft 62 which shaft is connected to rotor 58 at the opposite end.

A positive displacement progressive cavity pump does not leak water at normal working pressures, (of 50 pounds per square inch or less) and therefore serves as a shut off valve in an operation such as this one in which water may exert minor hydrostatic pressure against either the pump's inlet or outlet port as explained in the following. Leakage is prevented because there is a constant contact and seal between the rotor and the neoprene stator whether the rotor is stationary or in rotation. The seal is a double line of contact existing between rotor and stator and as rotation of the rotor proceeds a rolling of this double line of contact results together with a progression of the pump cavities 64 toward the outlet port 66 of the pump—hence the displacement is both positive and progressive, FIG. 7 and FIG. 8.

Figure 6:
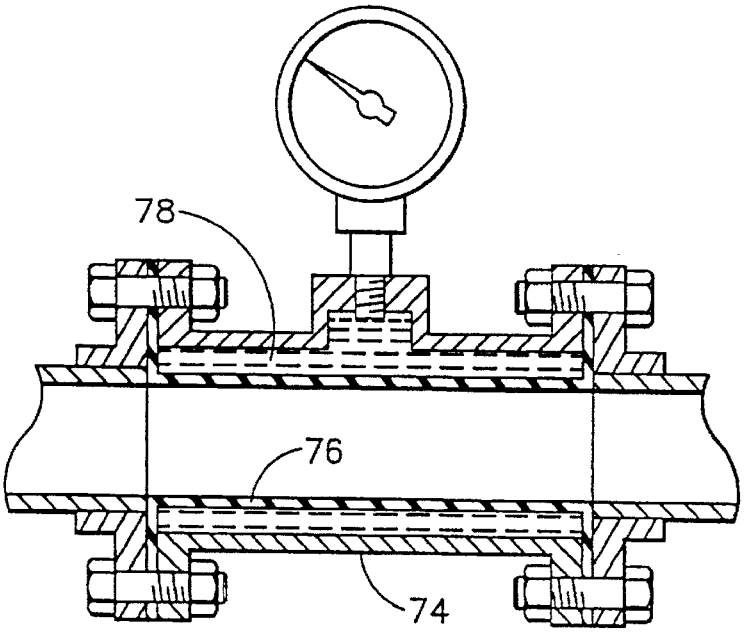
FIG. 6 is a sectional elevation of a pressure monitoring device also shown in FIG. 3 and FIG. 4.

In the present invention the slurry is pumped from pump 52 into communicating conduit 68. Said conduit conducts the slurry through a communicating, pressure measuring device 72, FIG. 1. Said pressure measuring device 72, FIG. 6, is composed of housing 74 and neoprene liner 76 internally disposed to conduct said slurry. Between neoprene liner 76 and metal housing 74 is annulus 78 which is totally oil filled. Pressure gauge 80 communicates with said oil and receives and registers all pressure prevailing in said oil. This pressure varies in accordance with the slurry pressure as said slurry is pumped forward into the homogenizing apparatus of the invention. Noting the position of device 72 at the approach to tank homogenizer 70, FIG. 1, it is clear that the pressure reading on gauge 80 reflects the maximum pressure prevailing at any given time within said tank homogenizer.

Figure 3:
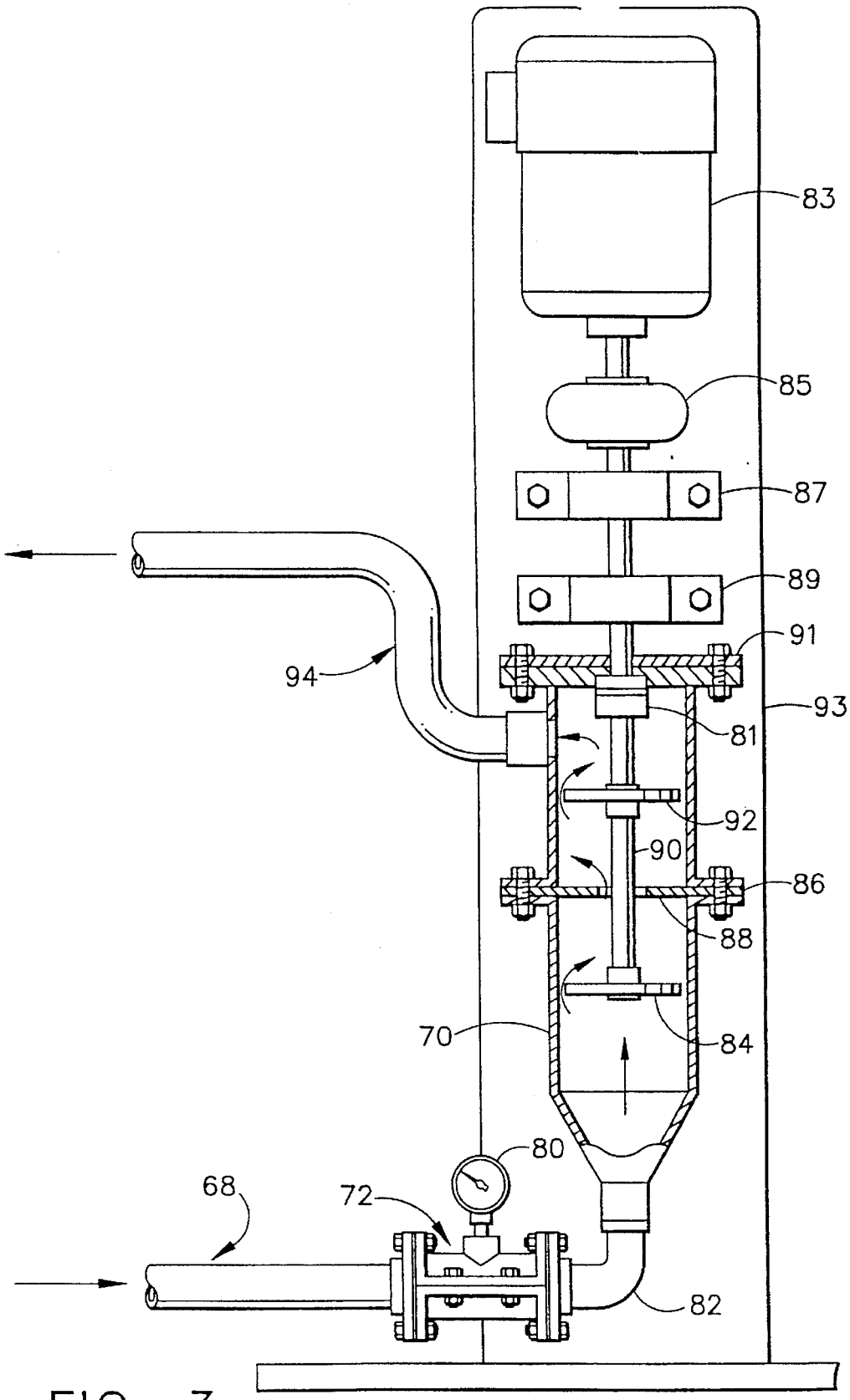
FIG. 3 is a frontal elevation of the tank homogenizing apparatus partly in section and partly in breakaway.

The slurry flows from pressure measuring device 72 through conduit 82, FIG. 3, which conducts said slurry into communicating tank homogenizer 70. Said communication takes place at the extreme bottom of said tank unit 70. Said slurry upon entering the tank encounters rotating disc 84 and flowing upward passes between the periphery of disc 84 and the inner wall of the tank. Tank homogenizer 70 is composed of two (or more) sections allowing disassembly for disc removal and cleanout, etc. and is joined and bolted at the point of separation 86, FIG. 1 and FIG. 3. Between the two sections of said tank homogenizer may be disposed orifice plate 88, FIG. 3. Said slurry must, in this case, flow toward the tank center and hence upward through said orifice in the clearance space encircling drive shaft 90. Said slurry continuing to flow upward must alter course and flow again to the tank wall and around the periphery of disc 92. Above disc 92 the slurry exits said tank homogenizer and enters communicating conduit 94. Said conduit conducts the slurry upward above the highest point within the tank homogenizer. The purpose of this will be explained in the following. Said slurry during its passage through said tank homogenizer has been transformed into a small celled homogeneous more viscous and foam-like mix. All of the metered air which entered the closed system commencing with the positive displacement pump is retained but is transformed into multitudes of relatively small uniform air cells. When said slurry emerges from conduit 94, it is referred to as foamed or cellular concrete or foamed plaster slurry and it may be then deposited at the point of use for whatever purpose is intended.

At this point an explanation of the functioning of tank homogenizer 70 is in order. It has been discovered that several important advantages result from using the tank homogenizer in the manner described.

It should be understood that cementitious material must regularly be purged from all the apparatus, conduits, pumps and devices which it traverses in being produced, homogenized and deposited for use. This purging is done at intervals by providing a copious flow of water through the entire system immediately after the flow of slurry has ceased. When the next pouring round of slurry begins, the entire system is wet from the previous water washout and water lies in all areas from which it cannot drain. For example the tank homogenizer 70 is full of water; the conduit 68 connecting the pump to the tank homogenizer is full of water and the riser of the conduit 94 at the outlet of the tank homogenizer is full of water. Although the natural arrangement would seem to be one whereby the slurry conduit enters the tank homogenizer at the top and the exit is at the bottom so that the purging water might drain from the tank homogenizer and leave it empty, the present invention, to the contrary, chooses the opposite arrangement as herein described. The foamed slurry produced is generally of lighter density than water but nevertheless once pumping begins the slurry pushes the water ahead as said slurry enters the conduits of the system and continues to do so as it enters the bottom of the water-filled tank homogenizer. There is surprisingly little dilution of the slurry by the water. The water in the entire system is forced to flow out immediately ahead of the oncoming slurry. Certain important advantages are thereby gained.

One, the slurry enters the tank homogenizer under pressure sufficient to overcome the hydrostatic head pressure exerted by the tankful of residual wash water. This automatically pressurizes the slurry in the tank (and pressure in the tank homogenizer is a requirement for successful practice of the present invention). If the slurry were to enter an empty tank from the top it would be necessary to pinch or restrict the outlet conduit in order to create pressure and thus completely fill the tank with slurry rapidly. Typically there is a slurry pressure within the tank homogenizer as measured by pressure gauge 80 FIG. 3 of five to ten pounds per square inch.

Two, the circumstance where purging water fills the tank homogenizer and exerts pressure in the conduit leading back to the positive displacement pump, continually tests said pump for leakage. If a leak eventually develops, the water will seep through the pump and fill and overflow the pump hopper thus giving a signal for pump repair.

Three, as a result of the immediate attainment of pressure in the cylindrical tank, the slurry produced by the procedure herein described (in at bottom, out at top) exhibits a more uniform cellular structure and higher viscosity, than is obtained by the reverse arrangement.

Four, by having the tank homogenizer water-filled whenever it is not slurry filled assures that the mechanical seal 81, FIG. 3, on the drive shaft never will rotate dry and unlubricated. Seals of this type which are capable of sealing against leakage while inundated in slurry are very susceptible to damage when rotating without lubrication for even a few moments. The purpose of the rising section of conduit 94, FIG. 3, is to insure that the important mechanical seal remains inundated following the purging cycle with said riser 94 functioning to prevent any of the water from draining out of the tank to expose the seal. Thus the seal will never be dry when the unit is started in rotation.

Figure 5:
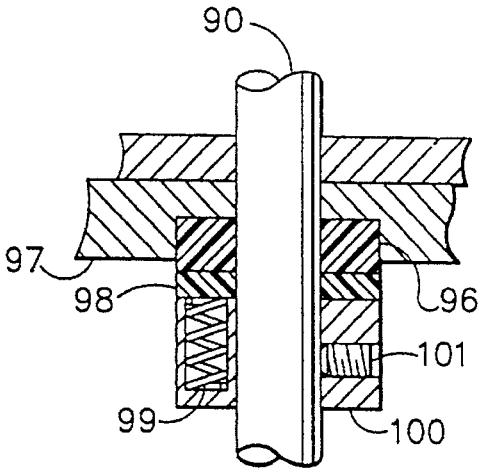
FIG. 5 is a sectional elevation of a mechanical seal also shown in FIG. 3.

As shown in FIG. 5, said mechanical seal is complex. It consists of seal 96 pressed into plate 97 which forms the top of the tank homogenizer. Rotating seal 98 contacts stationary seal 96 under pressure supplied by compressed springs 99 which are located in collar 100. Said collar is pressed upon shaft 90 and secured with set screw 101.

Returning to FIG. 3, the driving means for shaft 90 of the tank homogenizer are shown to consist of electric motor 83, flexible coupling 85, pillow block bearings 87 and 89. Mounting plate 91 bolts to the tank homogenizer and is itself rigidly secured to upright support member 93. Motor 83 in the preferred embodiment is equipped with control means (which are capable of varying the speed of said motor). It has been observed that speed changes for said motor result in changes of bubble structure in the cellular product, (all other variables unchanged). At higher motor speeds air cells in the slurry are finer than at lower speeds which tend to make them larger and coarser.

While a particular embodiment has been illustrated and described, it will be obvious to those skilled in the art that various changes and modifications may be made without departing from the invention and it is intended to cover in the appended claims all such changes and modifications that fall within the true spirit and scope of the invention.

What is claimed is:

1. An apparatus for continuously introducing a volume of air into a flowing slurry composed of cementitious material, water and an air entraining agent and for homogenizing said volume of air into bubbles or cells of relatively small and uniform size within said slurry, comprising:

means for pumping said slurry with a positive displacement pump; said pump having an inlet port, and an outlet port, means for directing the slurry of cementitious material, water and air entraining agent to the inlet port of the pump, said pump inlet port also being open to the atmosphere for induction of air into the pump, means for operating said pump at a rate of feed above the rate at which slurry is delivered to said inlet port, thereby providing a capability for said pump to draw air together with said slurry into the inlet port of said pump;

a closed homogenizing apparatus, means for conducting said slurry and accompanying air from the outlet port of said pump to the closed homogenizing apparatus;

said homogenizing apparatus comprising means for homogenizing said air into bubbles or cells of relatively small and uniform size within said slurry, and means for discharging the aerated and homogenized slurry from said homogenizing apparatus and conducting it to a point of deposit.

2. An apparatus as recited in claim 1 wherein said positive displacement pump is a progressive cavity pump.

3. An apparatus as recited in claim 2 wherein said means for operating said pump is infinitely variable within set ranges thereby providing precise control of the volume of air drawing into said pump and blending with said slurry.

4. An apparatus as recited in claim 1 wherein said homogenizing apparatus comprises a cylindrical tank, rotatable homogenizing element means, disposed within said tank, and means for rotating said homogenizing element means.

5. An apparatus as recited in claim 4 wherein said slurry and accompanying air enter said cylindrical tank at the lowest point and proceed generally vertically to exit at an upper level of said homogenizing apparatus.

6. An apparatus as recited in claim 4 wherein said slurry and accompanying air are homogenized in traversing said cylindrical tank and wherein said homogenized slurry and air is discharged into a conduit, said conduit being disposed so that a portion thereof rises above said cylindrical tank whereby when the tank is flushed with liquid in being cleaned, the liquid will be retained in the tank and the tank will be filled with liquid.

7. An apparatus as recited in claim 6 wherein the cylindrical tank includes a top panel; and said rotating means consists in part of a centrally disposed shaft passing through the top panel of said cylindrical tank and wherein a two part mechanical sealing means is disposed so that part of said means is held integrally with said shaft and part of said means is held integrally in said top panel of said tank and further comprising driving means for said shaft located outside said cylindrical tank.

8. An apparatus as recited in claim 4 wherein said means for rotating said homogenizing element means consists of a drive motor incorporating means for varying the revolutions per minute of said motor by infinitely small increments.

9. An apparatus as recited in claim 8 wherein the homogenizing element means comprise an anterior disc and a posterior disc, said discs being circular and disposed centrally of the cylindrical tank in axially spaced relation, and an orifice means is positioned between the circular discs, thereby compelling all material flowing through said cylindrical tank to pass through said orifice after passing the periphery of the anterior disc and prior to passing the periphery of the posterior disc.

10. An apparatus as recited in claim 4 wherein said homogenizing element means are circular discs centrally disposed within said cylindrical tank.

11. An apparatus as recited in claim 1 wherein said air entraining agent is a liquid and wherein said liquid agent is introduced into the water component of said slurry prior to said water being joined with the cementitious material in forming said slurry.

12. A method for continuously introducing air at a controlled rate into a flowing slurry composed of cementitious material, water and foaming agent, and for homogenizing said introduced air into bubbles or calls of relatively small and uniform size comprising the steps of:

directing said flowing slurry into the inlet port of a positive displacement pump having an inlet port open to the atmosphere;

drawing a volume of air together with said slurry into said pump to entrain air into the slurry passing through the pump, by operating said pump at a speed in excess of the speed rate required to pump the total quantity of flowing slurry entering said pump;

homogenizing the slurry and entrained air, after its discharge from the pump, said homogenizing step including an intense mixing action which activates the foaming agent and produces a uniform slurry mix containing air bubbles of relatively small size; and delivering said slurry mix through a conduit to a remote point of use.

13. The method as recited in claim 12 wherein said cementitious material is plaster and said liquid is water.

14. A method as recited in claim 12 wherein said cementitious material is Portland cement and said liquid is water.

15. A method as recited in claim 12 wherein said air entraining agent incorporates chemical means for stabilizing said aerated and homogenized slurry to prevent decrease of volume due to loss of homogenized air following discharge of said homogenized slurry from said homogenizing step.

16. A method as recited in claim 12 wherein said air entraining agent is a dry surfactant proportionally added to said cementitious material prior to use of said cementitious material.

17. A method as recited in claim 12 wherein said homogenizing step includes a device that is cylindrical and incorporates a rotating disc and wherein homogenization of said slurry is accomplished as said slurry is forced to pass between the periphery of said rotating disc and the inner surface of the cylindrical homogenizing device.

18. A method as recited in claim 12 wherein said rotating disc are driven by means which permit variation of the revolutions per minute of said disc by infinitely small increments and wherein said variation of speed results in changes of the relative size and dispersement of air cells in the matrix of said slurry whereby a coarse cellular structure results from slower rotation and relatively a finer cellular structure results from higher rotational speeds.

* * * * *